US008708735B2

(12) United States Patent
Aime et al.

(10) Patent No.: US 8,708,735 B2
(45) Date of Patent: Apr. 29, 2014

(54) SPLITTER CONNECTOR UNIT FOR ELECTRICAL INSTALLATIONS

(75) Inventors: Ugo Aime, Poirino (IT); Giovanni Turco, Turin (IT); Marco Zucca, Moncalieri (IT)

(73) Assignee: Tyco Electronics AMP Italia SRL, Collegno (Torino) (IT)

( * ) Notice: Subject to any disclaimer, the term of this patent is extended or adjusted under 35 U.S.C. 154(b) by 83 days.

(21) Appl. No.: 13/580,290

(22) PCT Filed: Feb. 14, 2011

(86) PCT No.: PCT/EP2011/052147

§ 371 (c)(1),
(2), (4) Date: Aug. 21, 2012

(87) PCT Pub. No.: WO2011/101318

PCT Pub. Date: Aug. 25, 2011

(65) Prior Publication Data

US 2012/0322298 A1 Dec. 20, 2012

(30) Foreign Application Priority Data

Feb. 22, 2010 (IT) ..... TO2010A0128

(51) Int. Cl.
*H01R 31/08* (2006.01)

(52) U.S. Cl.
USPC ..... 439/510

(58) Field of Classification Search
USPC ..... 439/510, 76.1, 77, 82, 511, 507, 792, 439/810, 357
See application file for complete search history.

(56) References Cited

U.S. PATENT DOCUMENTS 4,950,171 A * 8/1990 Muzslay ..... 439/76.1
5,127,382 A 7/1992 Imoehl (Continued)

FOREIGN PATENT DOCUMENTS

EP 0739060 A2 10/1996
EP 2020708 A1 2/2009

OTHER PUBLICATIONS

International Search Report and Written Opinion issued by the European Patent Office, dated May 25, 2011 for related International Application No. PCT/EP2011/052147; 11 pages.

(Continued)

*Primary Examiner* — Jean F Duverne
(74) *Attorney, Agent, or Firm* — Faegre Baker Daniels LLP

(57) ABSTRACT

A shunt connector assembly for electrical systems comprises a body including a first, a second and a third coupling portion (6, 7, 8) for coupling to respective connectors. The contacts of the first and second coupling portions (6, 7) are defined by the opposite ends of a first group of metal pins of circular section (R1) received inside the body (2) of the connector assembly. The contacts of the third coupling portion (8) are defined by first ends of a second group of metal pins of circular section (R2) arranged parallel to and spaced from the pins of the first group. Each pin of the first group (R1) is electrically connected to a respective pin of the second group (R2) by a metal bridging element in the form of a planar lamina extending substantially in the plane containing the axes of the pins connected by said bridging element and integrally incorporating at each end a bent back-portion defining a resiliently deformable open bushing that surrounds and clasps a respective metal pin (R1, R2).

7 Claims, 12 Drawing Sheets

(56) References Cited

U.S. PATENT DOCUMENTS

Figure 1:
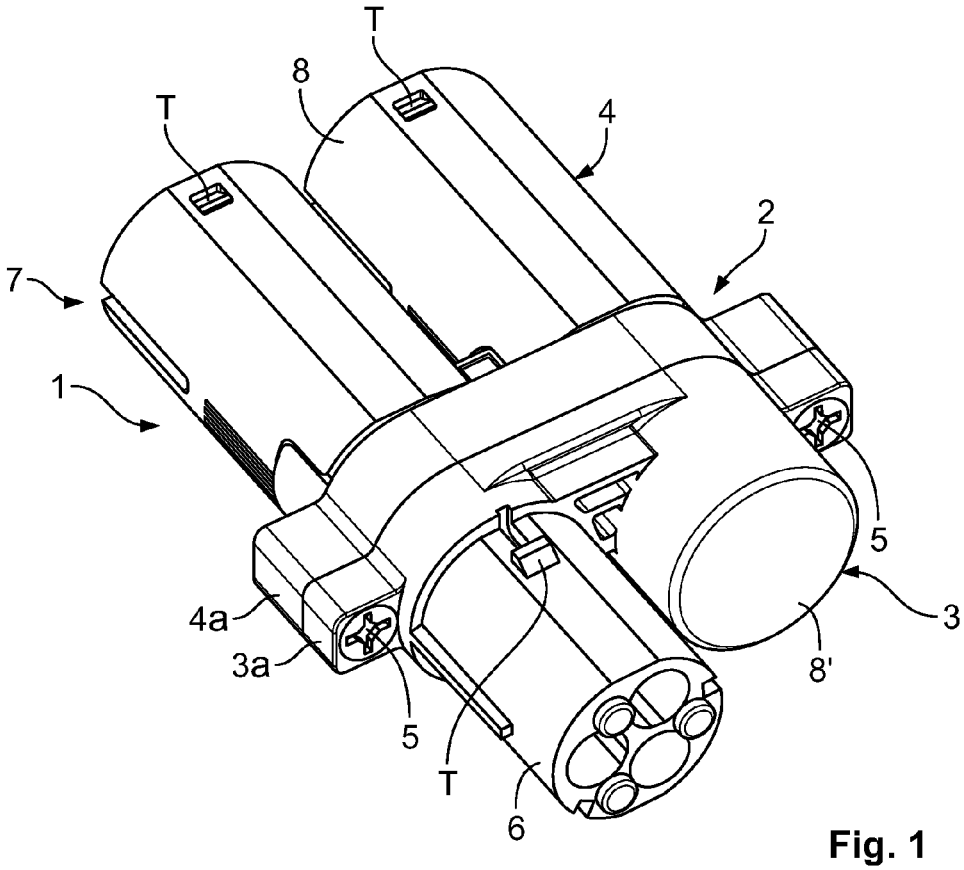

| | | | | |
|---|---|---|---|---|
| 5,675,300 | A | 10/1997 | Romerein | |
| 6,769,637 | B2 * | 8/2004 | Nakamura et al. | 239/585.1 |
| 7,448,902 | B1 * | 11/2008 | Irwin et al. | 439/489 |
| 7,641,500 | B2 * | 1/2010 | Stoner et al. | 439/357 |
| 7,878,869 | B2 * | 2/2011 | Murano et al. | 439/792 |
| 7,883,362 | B2 * | 2/2011 | Ichio et al. | 439/511 |
| 2004/0043674 | A1 | 3/2004 | Dunne | |
| 2005/0233634 | A1 * | 10/2005 | Kollmann | 439/510 |

OTHER PUBLICATIONS

International Preliminary Report on Patentability issued by the International Bureau of WIPO, Geneva, Switzerland, dated Aug. 28, 2012 for related International Application No. PCT/EP2011/052147; 6 pages.

* cited by examiner

SPLITTER CONNECTOR UNIT FOR ELECTRICAL INSTALLATIONS

The present invention relates to a shunt connector assembly for electrical systems, in particular electrical systems of the type comprising a body including at least a first, a second and a third coupling portion for coupling to respective connectors, said first and second coupling portions being aligned with one another and turned in opposite directions, said third coupling portion being arranged parallel to and beside said second coupling portion, and each of said coupling portions having a plurality of contacts.

Connector assemblies of the aforementioned type are used in various applications, particularly in electrical systems that operate at 16 amps, for example in order to power light sources in shop furniture or fittings, or else in commercial refrigerators, or in architectural applications, public buildings, schools and hospitals.

In all applications of this type it would be particularly advantageous to provide a connector assembly that is very compact and at the same time is functional and easy to handle during installation and can also be assembled during the production phase by simple, rapid procedures.

In order to achieve the above-mentioned object, the invention relates to a shunt connector assembly having the features mentioned at the outset of the present description and also characterised in that:

the contacts of the first and second coupling portions are defined by the opposite ends of a first group of metal pins of circular section and received inside the body of the connector assembly, the contacts of said third coupling portion being defined by first ends of a second group of metal pins of circular section arranged parallel to and spaced from the pins of the first group, and each pin of the first group is electrically connected to a respective pin of the second group by a metal bridging element in the form of a planar lamina extending substantially in the plane containing the axes of the pins connected by said bridging member and integrally incorporating at each end a bent-back portion defining a resiliently deformable open bushing that surrounds and clasps a respective metal pin.

In a preferred embodiment the pins of the first group and the pins of the second group are arranged so as to be circumferentially equidistant about a respective central axis, in such a way that the bridging elements that connect, in pairs, the pins of the two groups lie in different planes and parallel to one another.

Again in the case of the aforementioned preferred embodiment, the body of the connector assembly comprises a first casing portion and a second casing portion connected to one another by screws and a ring seal arranged therebetween. The first casing portion incorporates said first coupling portion and the second casing portion incorporates said second and third coupling portions.

Each of the aforementioned metal pins of circular section of the first and second groups integrally incorporates one end formed as a socket and an opposite end formed as a plug as well as, in its intermediate portion, a plurality of collars of enlarged diameter for insertion with an interference fit in respective cavities in the body of the assembly. The aforementioned bridging elements are received in respective seats formed in a front face of said second casing portion, said seats being provided in the form of parallel, spaced slits and having widened ends defined by the cavities that receive the aforementioned metal pins and open into the aforementioned front face, in such a way that the metal pins can be inserted into the body of the connector assembly and held therein once the bridging elements have first been positioned in their seats.

Again in the case of the aforementioned preferred embodiment, the aforementioned first, second and third coupling portions have a geometry that is circular in section. The first coupling portion is a cylindrical body and has a front face from which more axial cylindrical cavities extend, in which the plug ends of respective metal pins are received. Each of said second and third coupling portions comprises a cylindrical base from which a plurality of axial tubular elements extend, in which the socket ends of respective metal pins are arranged.

In the connector assembly according to the invention, the aforementioned bridging elements that connect, in pairs, the metal pins of the two groups have an active connection operating simultaneously as electrical conductors and spring mechanisms to secure the connection.

Figure 2:
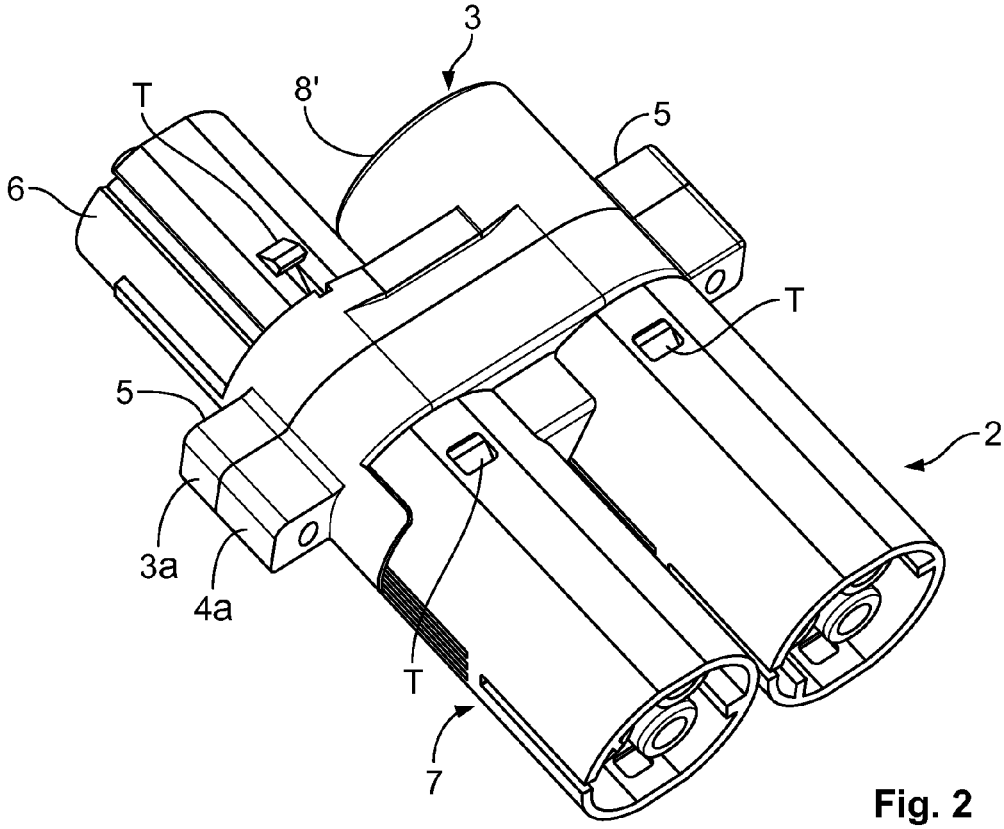
Figure 3:
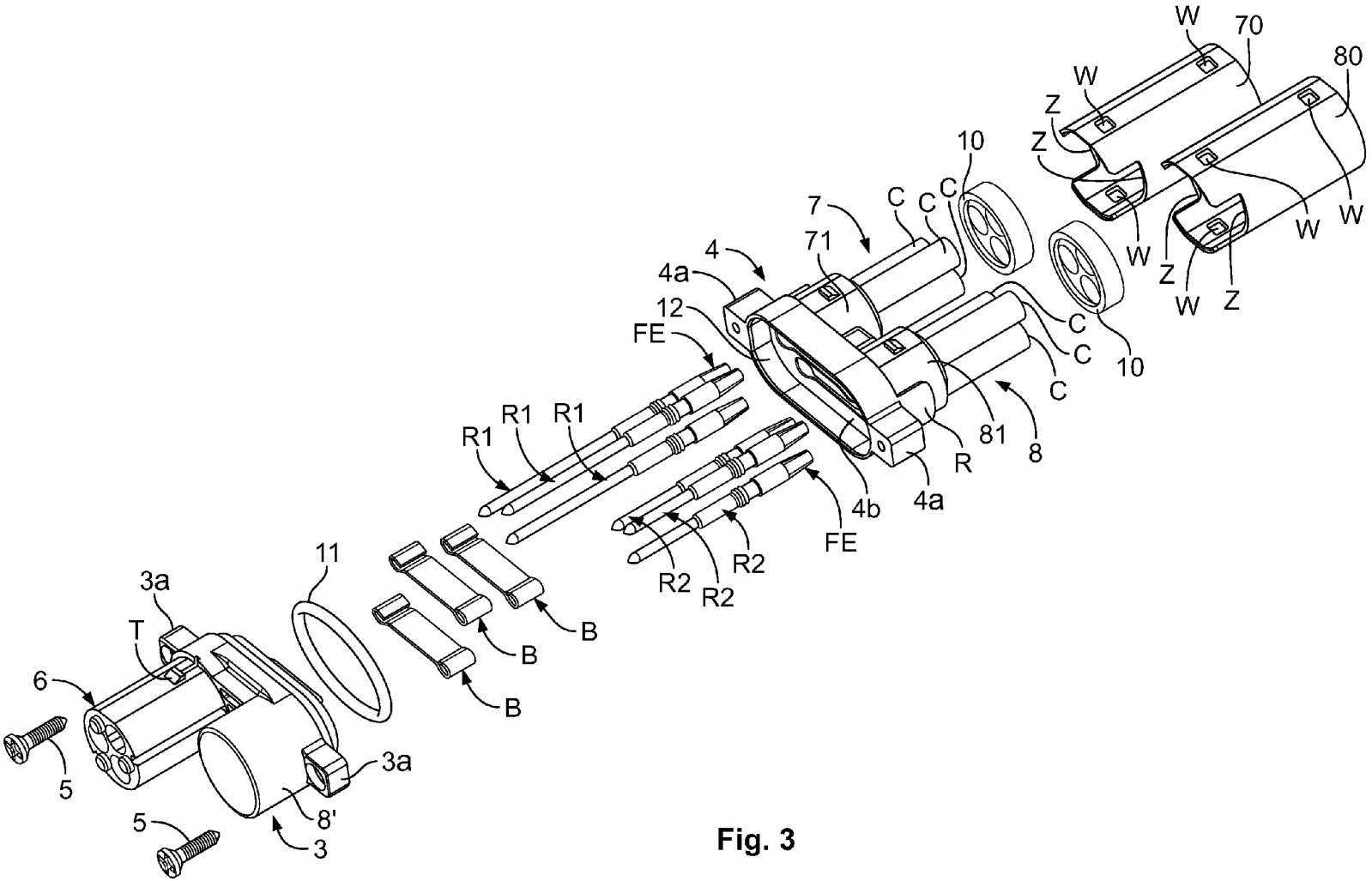
Figure 12:
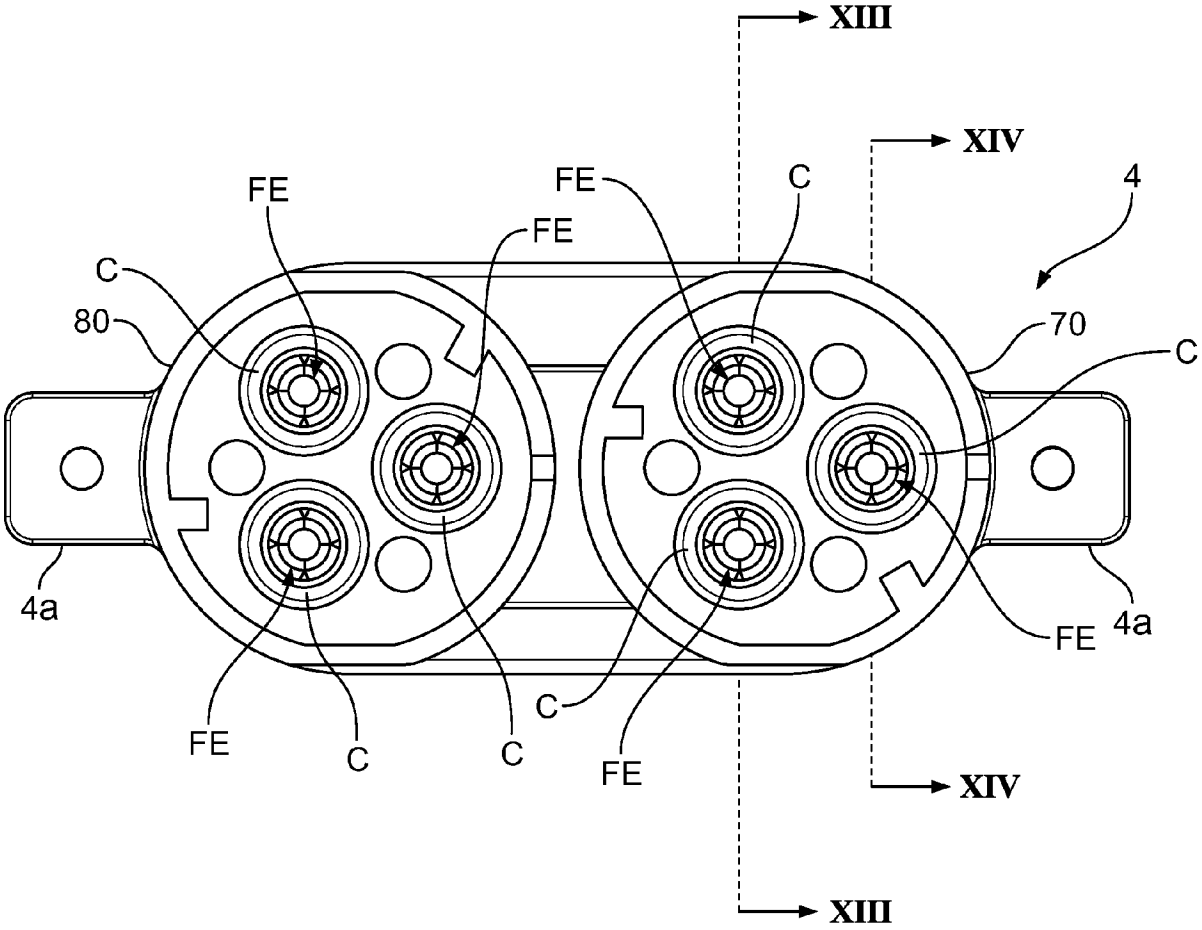
Figure 13:
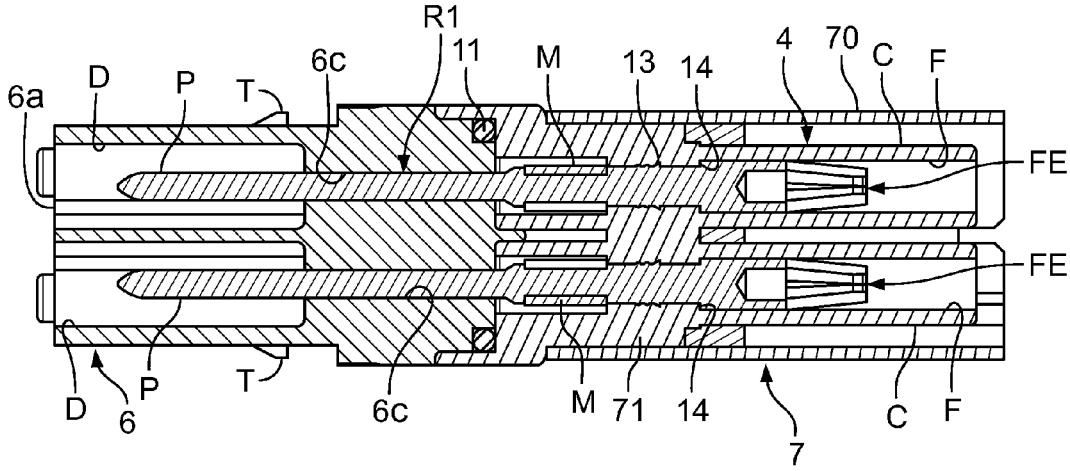
Figure 14:
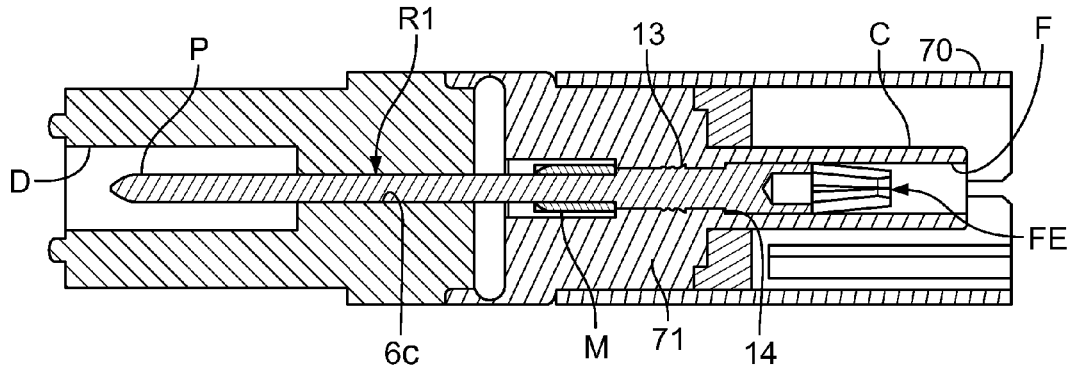
Figure 15:
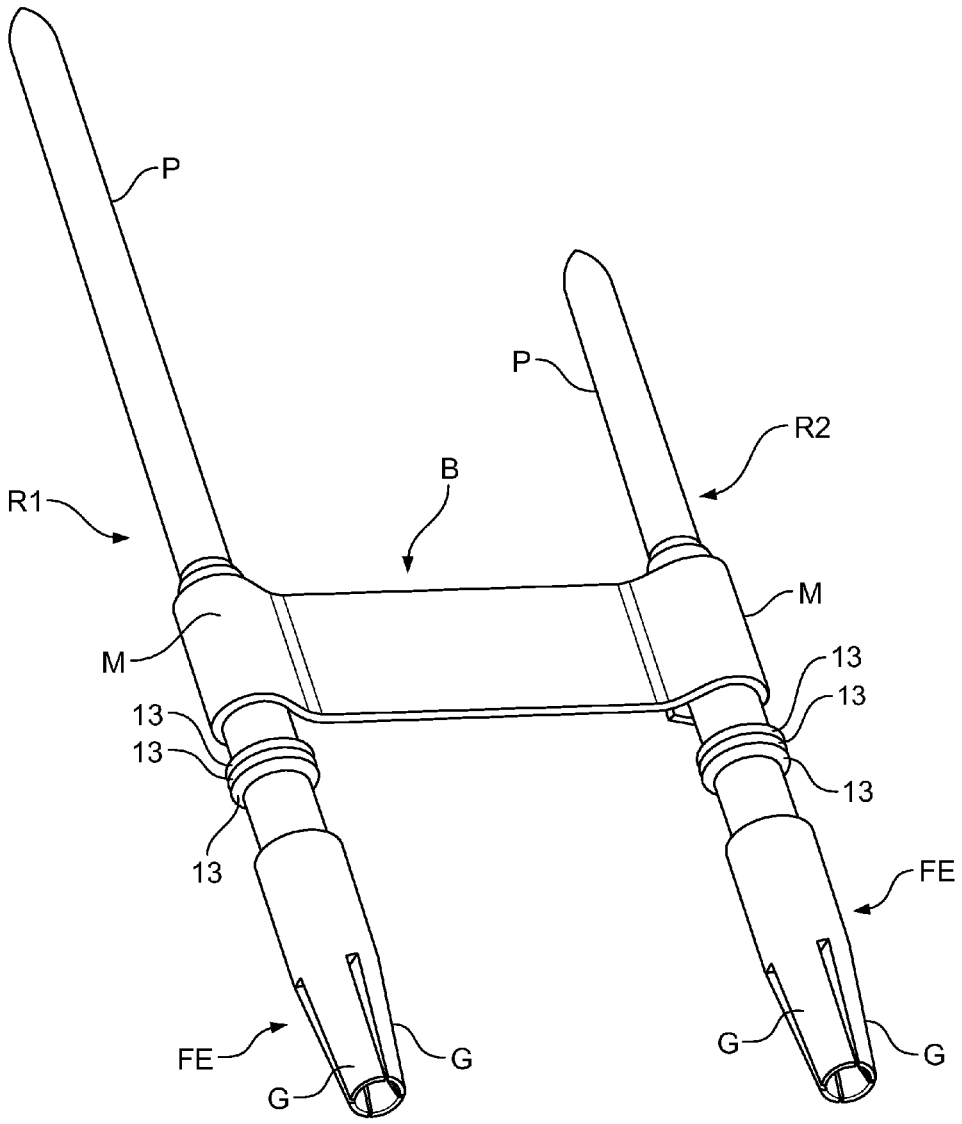

Further features and advantages of the invention will become clear upon reading the following description with reference to the accompanying drawings, provided purely by way of non-limiting example and in which:

FIGS. 1 and 2 are perspective views of a preferred embodiment of the connector assembly according to the invention, FIG. 3 is an exploded perspective view of the connector assembly of FIG. 1, FIGS. 4-11 are perspective views illustrating the successive phases of the procedure for assembling the connector assembly of FIG. 1, FIG. 12 is a front view of the connector assembly of FIG. 1, FIGS. 13 and 14 are sectional views along lines XIII-XIII and XIV-XIV of FIG. 12, and FIG. 15 is an enlarged perspective view of a component of the connector assembly according to the invention.

In the drawings, numeral 1 denotes, as a whole, an embodiment of the connector assembly according to the invention that can be used in electrical systems, for example for powering light sources in shop furniture or fittings, or in commercial refrigerators or in architectural applications, public buildings, schools and hospitals. The example illustrated here is of the type with three coupling portions, applicable as a shunt or splitter for carrying currents up to 16 amps and 240 AC volts from an inlet to two outlets.

The connector assembly 1 comprises a body denoted as a whole by reference numeral 2 and defined by two casing portions 3, 4 made of a plastics material and having frontal juxtaposed flanges 3*a*, 4*a* that are connected to one another by screws 5.

The first casing portion 3 defines a first substantially cylindrical coupling portion 6 (see also FIG. 3) for coupling a respective connector (not shown), whereas the second casing portion 4 defines a second and third coupling portion 7, 8 for coupling to respective connectors (not shown). The coupling portions 6, 7 are aligned with one another and turned in opposite directions, whereas the coupling portion 8 is arranged parallel to and beside the coupling portion 7.

As can be seen in particular in FIGS. 1, 3, 7, 13 and 14, the coupling portion 6 is a substantially cylindrical portion with a front face 6*a* from which three axial cylindrical cavities D extend, distributed circumferentially about the central axis of the cylindrical portion 6. As can be seen in FIGS. 13 and 14, the cylindrical cavities D extend over part of the axial extent of the cylindrical portion 6, a cylindrical hole 6*c* of smaller diameter then extending from the base of each of the cylindrical cavities D as far as the opposite end of the casing element 3. Furthermore, as can be seen for example in FIGS. 1, 7 and 13, the cylindrical portion 6 has two wedge-shaped teeth T formed on the outer surface of the portion 6 in diametrically opposed regions for engagement with corresponding surfaces of the connector (not shown) to be coupled to the portion 6.

As can be seen in particular in FIG. 3, in FIGS. 4-7 and in FIGS. 13 and 14, the second and third coupling portions 7, 8 defined by the casing portion 4 each comprise an outer plastics material tubular casing 70, 80 with thin walls that is mounted on a cylindrical base 71 and 81 of the casing portion 4. The bases 71, 81 have peripheral portions in relief R that couple to corresponding recessed portions Z of an end edge of the outer casings 70, 80 (FIG. 3) in order to hold the casings 70, 80 on the bases 71, 81. Said bases also have, on their outer surface, wedge-shaped teeth T in diametrically opposed regions that cooperate with apertures W in the casings 70, 80 in order to hold the casings 70, 80 on the bases 71, 81.

Starting from each of the two cylindrical bases 71, 81, the casing portion 4 incorporates three axial tubular elements C distributed so as to be circumferentially equidistant about the geometrical axis of the respective cylindrical base. As can be seen in FIGS. 13 and 14, the cavity F in the tubular elements C projects through the respective base 71 or 81 so as to open into a front face 4*b* of the casing portion 4 (see also FIGS. 6 and 7). As can be seen in the drawings, seats S are formed in the aforementioned front face 4*b* as parallel, spaced slots, each of which has a widened end formed by a respective one of the aforementioned cavities F. The seats S receive in their interior the bridging elements B made of an electrically conductive metal material, for example a tin-plated copper alloy, in the form of planar laminae having bent ends so as to form resiliently deformable bushings M.

Figure 10:
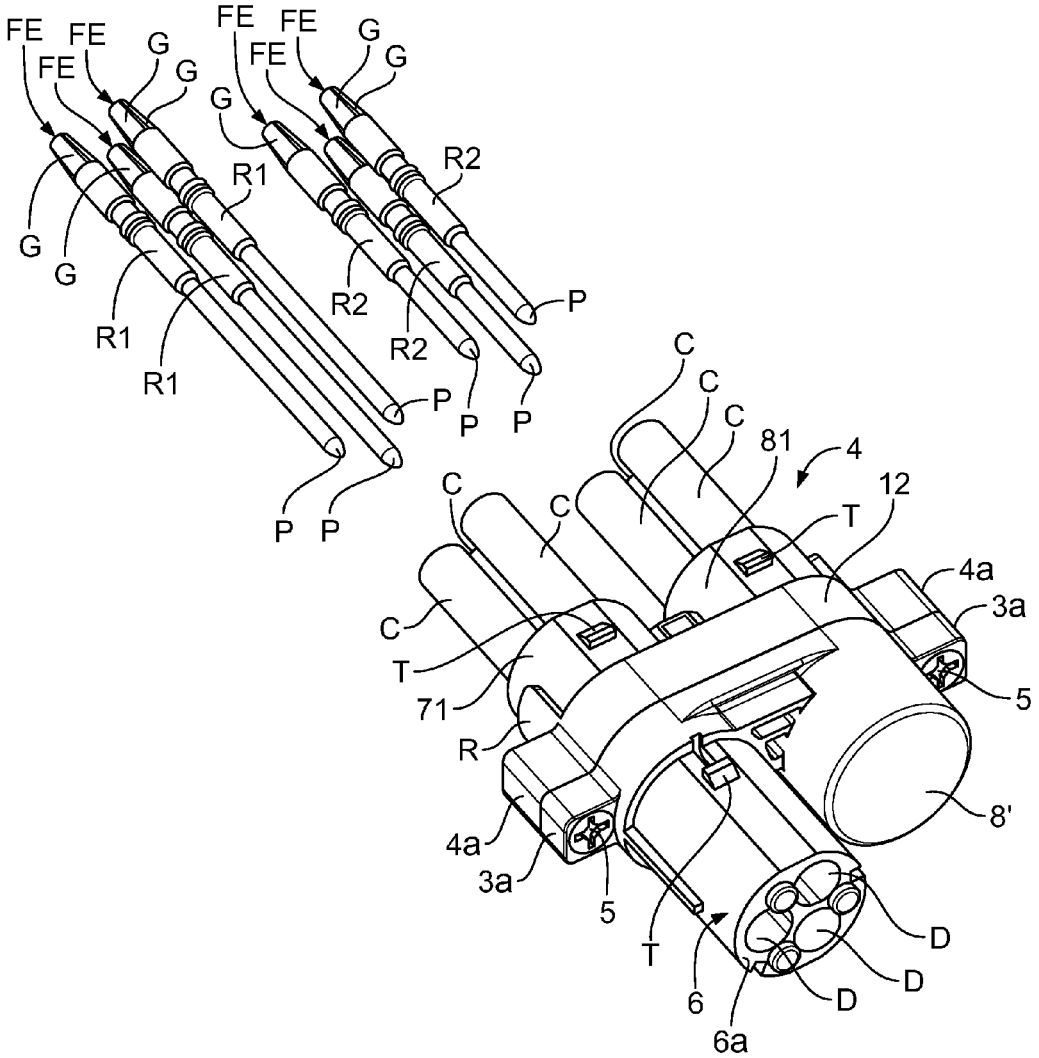
Figure 11:
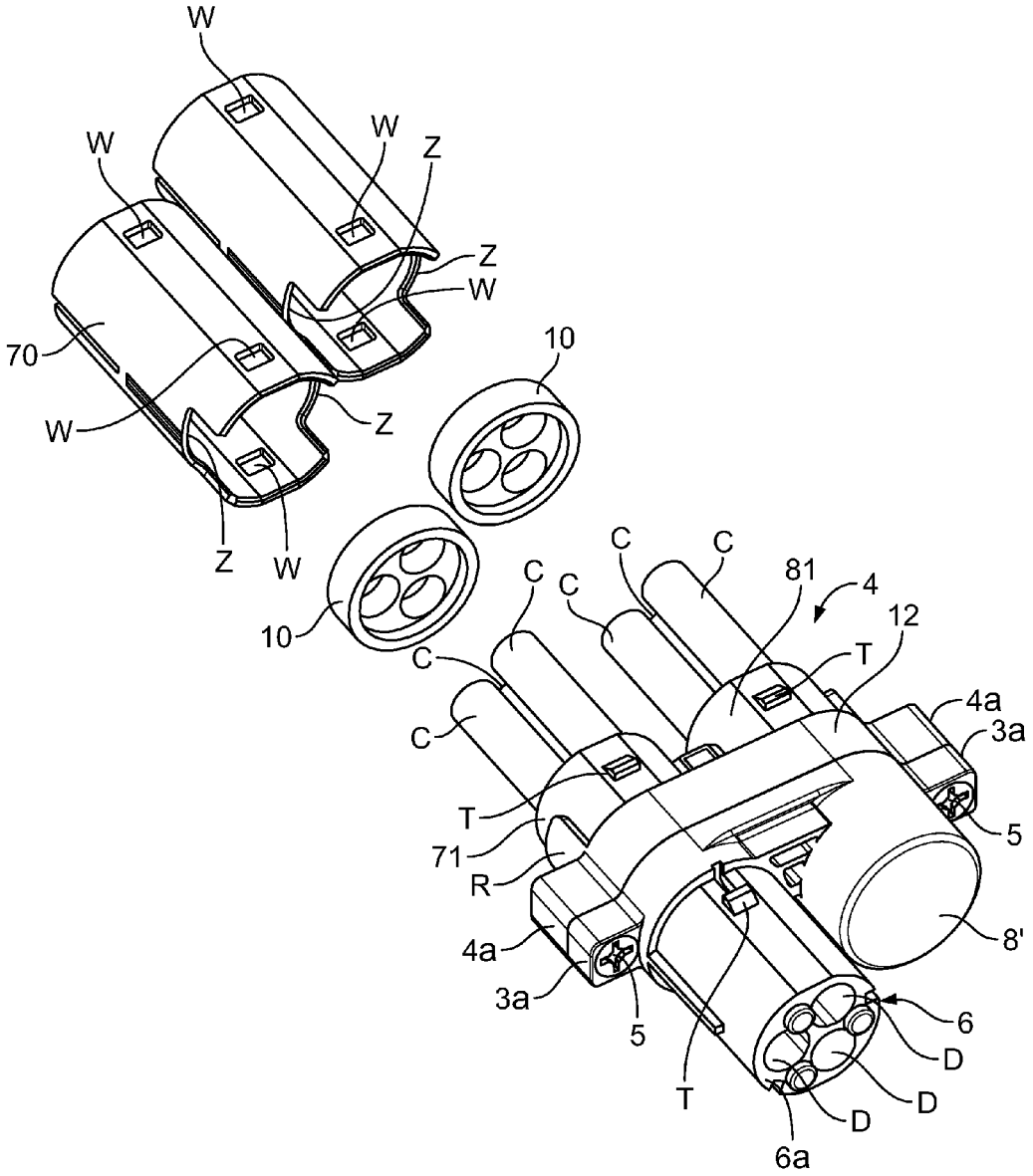

The metal contacts connected to the coupling portions 6, 7, 8 of the connector assembly according to the invention are formed by two groups of three metal pins R1 and R2 (see FIG. 10 in particular). Each of said metal pins is made of an electrically conductive metal material and is produced in one piece by turning. Each of the metal pins has an end defining a plug contact P and an opposite end defining a socket contact FE with an end socket defined inside resiliently deformable wings G.

The metal pins R1 of the first group are longer and more inserted through the entire length of the aligned coupling portions 6, 7 (see FIGS. 13 and 14) in such a way that the plug ends P form male contacts arranged inside the cylindrical cavities D in the coupling portion 6, whereas the ends FE form female contacts arranged inside the tubular elements C in the coupling portion 7.

It should be noted that the tubular elements C are dimensioned so as to be accommodated inside cavities in a respective coupling connector (not shown), said cavities being completely similar to the cavities D in the coupling portion 6. Similarly, the cavities D are adapted to receive tubular elements of the respective coupling connector, said tubular elements being completely similar to the tubular elements C of the connector assembly shown here.

The metal pins R2 of the second group are shorter than the metal pins of the first group R1 since use is made of their socket ends FE that are received inside the respective tubular elements C in the coupling portion 8. The opposite plug ends P of the pins R2 are instead received in a closed portion 8' of the casing element 3 and are not used as contacts.

In the embodiment shown here, the connector assembly according to the invention has three metal contacts connected to each coupling portion 6, 7, 8 that respectively form the earth contact, the neutral contact, and the phase contact. With reference to FIGS. 13 and 14, the two metal pins R1 define the neutral and phase contacts, whilst the metal pin R1 of FIG. 14 defines the earth contact. It can be seen that the pin R1 of FIG. 14 is slightly longer than the pins R1 of FIG. 13 insofar as, when coupling to other connectors, the earth contact has to be coupled before the neutral and phase contacts and, during uncoupling, the earth contact is the last to be disconnected.

Figure 7:
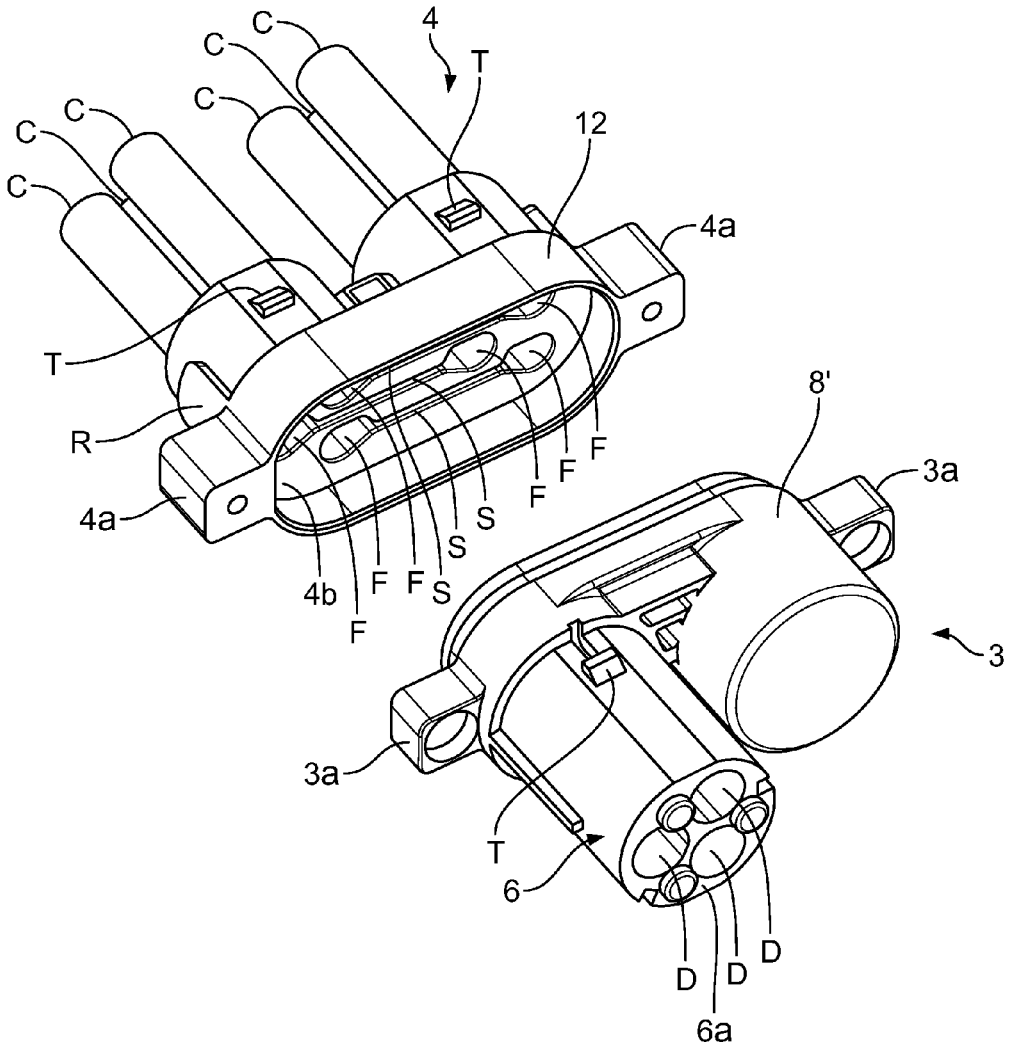

With reference again to FIG. 3, sealing washers 10 each in the form of a disc with three through-holes are applied over the tubular elements C of the casing portion 4, whereas a ring seal 11 of the O-ring type is placed over the circumferential edge 12 (see FIGS. 4 and 5) of a front portion in relief 3*c* of the casing portion 3. As can be seen in FIG. 7, said front face in relief 3*c* with the ring seal 11 placed thereon is received, in contact with the front face 4*b*, inside a peripheral sleeve 12 formed in one piece with the casing 4.

With reference to FIG. 15, each of the bridging elements B electrically connects one of the pins R1 of the first group to one of the pins R2 of the second group. The planar lamina body of each bridging element B extends substantially in the plane defined by the parallel and spaced axes of the respective pins R1 and R2. As is seen in particular in FIGS. 6 and 12, the circumferential arrangement of the two groups of pins is such that said pins can be connected, in pairs, via the three bridging elements B that are thus arranged in parallel and spaced planes defined by the seats S. Each resilient bushing end M of each bridging element B surrounds and clasps a respective pin so said bridging elements B simultaneously serve as electrical connection elements and retaining springs.

Lastly, FIG. 15 clearly shows that each of the pins R1, R2 has a set of collars of enlarged diameter R in order to ensure the interference fit of each of the pins R1, R2 inside the respective cavities F (see also FIGS. 13 and 14).

FIGS. 4-11 show the sequence of steps for assembling the connector assembly according to the invention.

Figure 4:
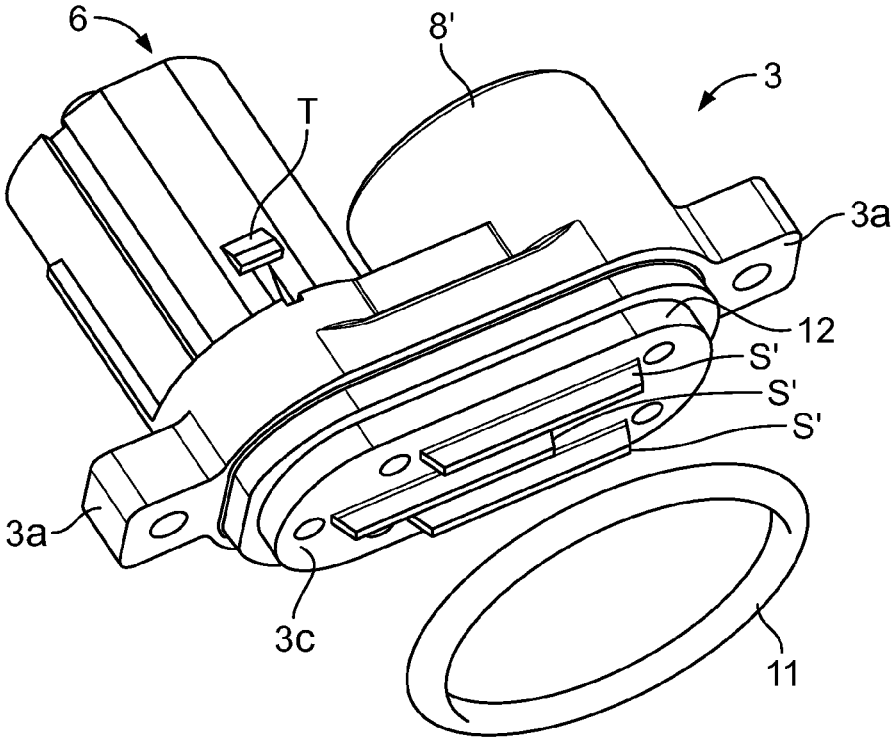
Figure 5:
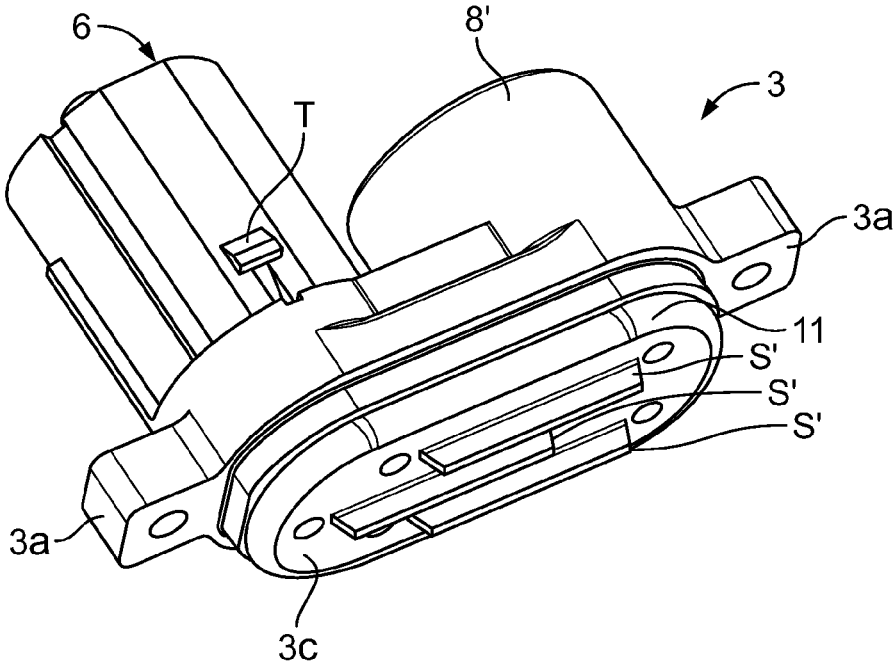
Figure 6:
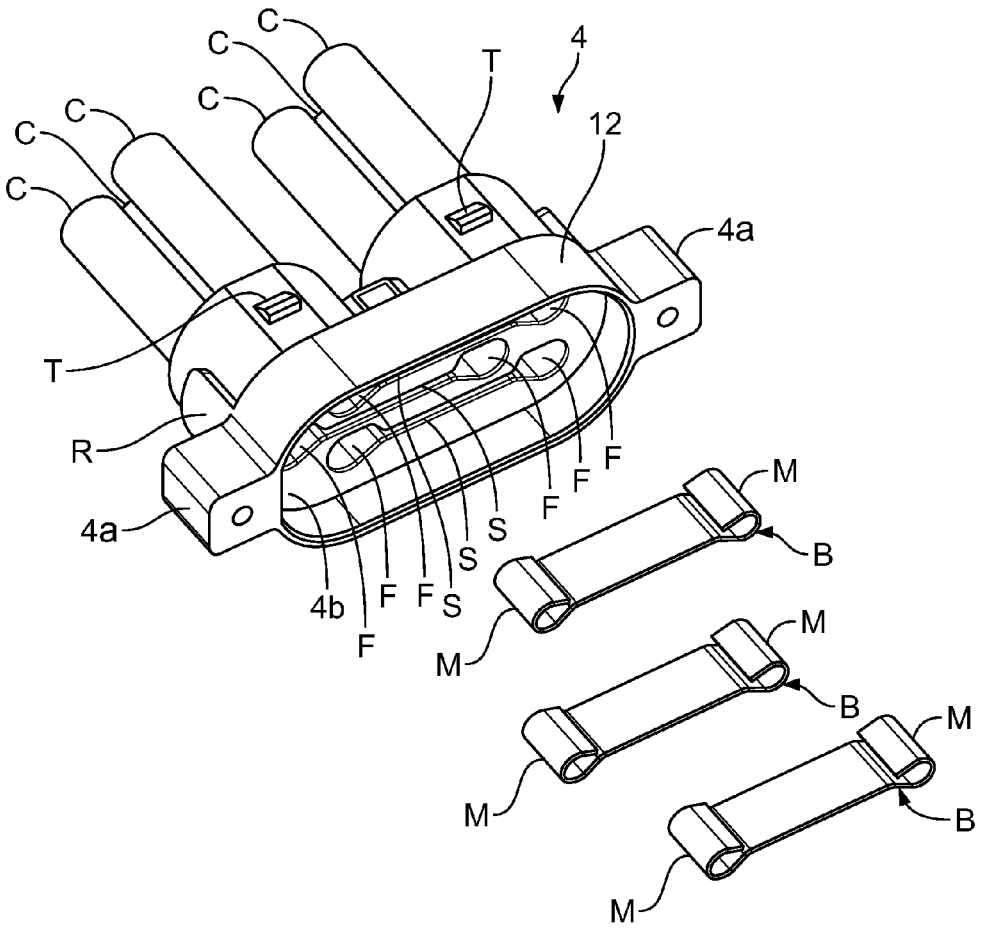
Figure 8:
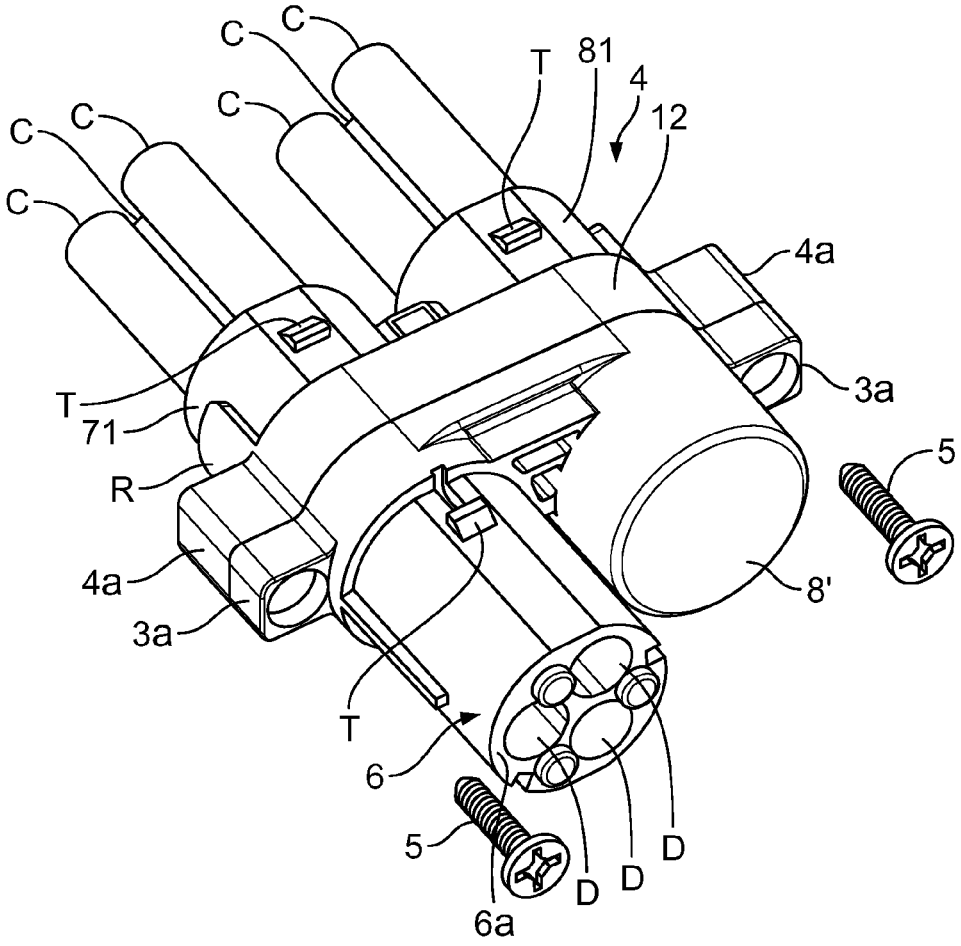
Figure 9:
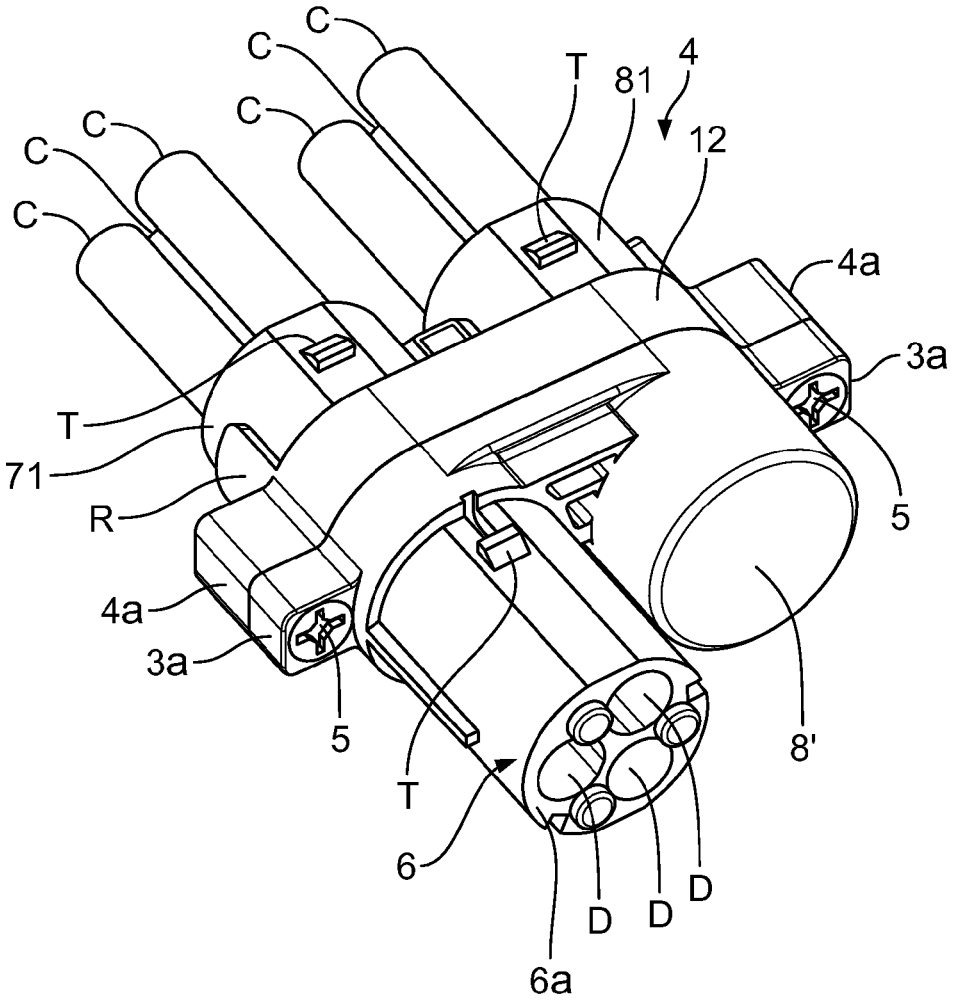

With reference to FIG. 4, the ring seal 11 is placed round the front portion in relief 3*a* of the casing portion 3 (FIG. 5). Once this has been done, the bridging elements B are mounted in the seats S in the front face 4*b* of the casing portion 4 (FIG. 6). The two casing portions 3, 4 thus can be assembled (FIG. 7) and held in position by the screws 5 (FIG. 8). It is noted that when the two casing portions 3, 4 are coupled, the bridging elements B are held in their seats by laminar projections S' (see FIGS. 4 and 5) that are received inside the seats S in the casing portion 4. Once the screws 5 have been screwed in (FIG. 9), the two groups of pins R1, R2 are introduced into their respective cavities by being inserted inside the tubular elements C in the coupling portions 7, 8 using the plug ends P as the leading ends. The pins are inserted until the socket ends FE contact a stop surface 14 (FIGS. 13 and 14) formed inside the internal cavity of the tubular elements C. In this state, each of the pins R1, R2 is held with an interference fit inside the holes passing through the base portions 71, 81, thanks also to the collars 13. Also in this state, each of the resilient bushing ends M of each bridging element B receives its respective pin forming the electrical and mechanical connection, each bridging element B therefore performing both functions. At this point, the sealing discs 10 can be assembled and the casings 70, 80 can therefore be held on the bases 71, 81 by engagement of the teeth T in the apertures W.

As is evident from the above, when the metal pins R1, R2 are inserted, the resiliently deformable bushings M formed by the ends of the bridging elements B deform so as to surround and accommodate the metal pins, thus giving rise to a normal contact force adapted to ensure mechanical and electrical connection to the pins. On the one hand, the purpose of such bridging elements is therefore to distribute the current from an inlet to two outlets and, on the other hand, to integrally incorporate the springs retaining said connection.

Of course, without affecting the principle of the finding, the constructional details and embodiments may be varied widely from those described and illustrated purely by way of example without departing from the scope of the present invention.

The invention claimed is:

1. Shunt connector assembly for electrical systems comprising a body including at least a first, a second and a third coupling portion for coupling to respective connectors, said first and second coupling portions being aligned with one another and turned in opposite directions and said third coupling portion being arranged parallel to and beside said second coupling portion, each of said coupling portions having a plurality of contacts, the contacts of the first and second coupling portions being defined by the opposite ends of a first group of metal pins of circular section received inside the body of the connector assembly, and the contacts of said third coupling portion are defined by first ends of a second group of metal pins of circular section arranged parallel to and spaced from the pins of the first group, each pin of the first group is electrically connected to a respective pin of the second group by a metal bridging element in the form of a planar lamina extending substantially in the plane containing the axes of the pins connected by said bridging element and integrally incorporating at each end a bent-back portion defining a resiliently deformable open bushing that surrounds and clasps a respective metal pin.

2. Connector assembly according to claim 1, wherein the pins of the first group and the pins of the second group are arranged so as to be circumferentially equidistant about a respective central axis, in such a way that the bridging elements that connect, in pairs, the pins of the two groups lie in different planes and parallel to one another.

3. Connector assembly according to claim 2, wherein the body has a first casing portion and a second casing portion connected to one another by screws and a ring seal arranged therebetween, said first casing portion incorporating said first coupling portion and said second casing portion incorporating said second and third coupling portions.

4. Connector assembly according to claim 3, wherein each of said metal pins of circular section of the first and second groups integrally incorporates one end formed as a socket and an opposite end formed as a plug, and in that each of said pins also integrally incorporates a plurality of collars of enlarged diameter for insertion with an interference fit in respective cavities in said body.

5. Connector assembly according to claim 4, wherein said bridging elements are received in respective seats formed in a front face of said second casing portion, said seats being provided in the form of parallel, spaced slits and having widened ends defined by the cavities that accommodate the aforementioned metal pins and open into the aforementioned front face, in such a way that the metal pins can be inserted into the body of the connector assembly and held therein once the bridging elements have first been positioned in their seats.

6. Connector assembly according to claim 5, wherein said first coupling portion is a cylindrical body and has a front face from which more axial cylindrical cavities extend, in which the plug ends of respective metal pins are received.

7. Connector assembly according to claim 5, wherein each of said second and third coupling portions comprises a cylindrical base from which a plurality of axial tubular elements extend, in which the socket ends of respective metal pins are arranged, each of said second and third coupling portions also including a cylindrical tubular casing coupled to the respective base.

* * * * *